US005310521A

United States Patent [19]

Asseiro et al.

[11] Patent Number: 5,310,521

[45] Date of Patent: May 10, 1994

[54] STEEL COMPOSITION FOR SUSPENSION SPRINGS

[75] Inventors: Anthony M. Asseiro, Burlington; Melvin E. Head, Ancaster; Gordon D. Millar, Hamilton, all of Canada

[73] Assignee: Stelco Inc., Hamilton, Canada

[21] Appl. No.: 981,081

[22] Filed: Nov. 24, 1992

[51] Int. Cl.[5] ..... C22C 38/46

[52] U.S. Cl. ..... 420/109; 148/908

[58] Field of Search ..... 148/328, 334, 335, 908; 420/109, 110, 111, 127

[56] References Cited

U.S. PATENT DOCUMENTS

| | | | |
|---|---|---|---|
| 4,289,548 | 9/1981 | Bucher et al. | 148/335 |
| 4,409,026 | 10/1983 | Yamada et al. | 75/124 |
| 4,574,016 | 3/1986 | Yamamoto et al. | 148/144 |
| 5,009,843 | 4/1991 | Sugimoto et al. | 148/908 |

FOREIGN PATENT DOCUMENTS

| | | | |
|---|---|---|---|
| 973659 | 11/1982 | U.S.S.R. | 148/908 |

*Primary Examiner*—Deborah Yee

*Attorney, Agent, or Firm*—Sim & McBurney

[57] ABSTRACT

A steel composition is provided having improved sag resistance and fatigue behavior properties adapting it to be suitable for coil and torsion bar suspension springs for passenger vehicles and light trucks of lesser weight. Critical to the composition is the use of vanadium in an amount of from about 0.05 to about 0.50 wt% or niobium in an amount of about 0.05 to about 0.20 wt%, sufficient nitrogen to ensure that the vanadium or niobium is in the form of vanadium nitride or niobium nitride respectively and the substantial absence of aluminum. The vanadium nitride or niobium nitride ensures fine grain formation and the improved properties. Other components may be present including carbon, silicon and chromium.

2 Claims, 7 Drawing Sheets

FRACTURE TOUGHNESS ($K_{IC}$) AT 23°C AS A FUNCTION OF HARDNESS (3 POINT BEND SPECIMENS: 5.5 X 10.0 mm CROSS-SECTION)

THE DYNAMIC RELAXATION OF PROTOTYPE COIL SPRINGS AS A FUNCTION OF TIME (STRESS LEVEL: 1175 MPa)

THE DYNAMIC RELAXATION OF PROTOTYPE COIL SPRINGS AS A FUNCTION OF TIME (STRESS LEVEL: 1080 MPa)

STEEL COMPOSITION FOR SUSPENSION SPRINGS

FIELD OF INVENTION

The present invention relates to a steel composition particularly adapted for use in suspension springs.

BACKGROUND TO THE INVENTION

A significant use of hot rolled steel bar is in coil and torsion bar suspension springs employed in passenger cars and light trucks. Manufacturers of these vehicles are placing greater requirements on suspension systems than has previously been the case. Vehicles weight reduction, size constraints, handling, performance and styling needs all impacting on the springs design. The two most significant requirements for coil and torsion bar springs are the need for smaller size or "package" and reduced weight. Package refers to the ability of the design to fit under increasingly lower engine hood lines and into shorter chassis frames and to allow increases in the available space passenger and cargo areas. In this regard, new suspension springs must be increasingly smaller than current designs. The desired weight reduction is an accompanying benefit of a smaller spring.

In terms of size and weight, a smaller spring translates into a steel bar of generally decreased diameter and length. These reductions will result in higher working stresses in the spring for the same load and spring rate. The inventors herein have developed a steel composition from which springs may be formed and which meets the size and weight needs while maintaining or enhancing spring performance, i.e. fatigue behavior and sag resistance.

The applicants are aware of certain scientific literature and prior patents relating to spring steel compositions and of certain commercially-available steel grades. In particular, U.S. Pat. No. 4,409,026 describes a spring steel composition for automobile use comprising 0.5 to 0.7 wt% C, 1.0 to ? .8 wt% Si, 0.1 to 1.0 wt% of Mn, below 0.7 wt% Cr, 0.03 to 0.5 wt% V and the balance iron and normally present impurities, and optionally at least one of Al, Zr, Nb and Ti, each contained in an amount of 0.02 to 0.I wt%. Accordingly, a critical combination of defined amounts of C, Si, Mn, Cr and V is required for this composition.

U.S. Pat. No. 4,574,016 describes a steel exhibiting good sag resistance and useful in a vehicle suspension spring comprising 0.5 to 0.80 wt% C, 1.50 to 2.50 wt% Si, 0.50 to 1.50 wt% Mn, plus 0.05 to 0.50 wt% V, 0.05 to 0.50 wt% Nb or 0.05 to 0.50 wt% Mo, with the remainder being iron together with impurities. The steel may further contain a member or members selected from 0.0001 to 0.01 wt% B, 0.2 to 1.00 wt% Cr and not greater than 0.0008 wt% N. Again, a critical combination of defined amounts of C, Si, Mn and V (or Nb or Mo) is required for this composition.

SUMMARY OF INVENTION

In accordance with the present invention, there is provided a novel steel composition having an enhanced sag resistance and satisfactory fatigue life behavior at elevated design stresses, which is suitable for use in coil and torsion bar suspension springs for vehicles, particularly passenger cars and light trucks. The enhanced sag resistance coupled with maintenance of fatigue life at high stress, permit springs produced from such steel to be made much lighter by a reduction in bar diameter and length. This result is achieved by using a critical combination of component content of the steel.

In accordance with one aspect of the present invention, there is provided a steel composition for use in vehicle coil and torsion bar suspension springs, comprising iron containing (a) about 0.05 to about 0.50 wt% vanadium or about 0.05 to about 0.20 wt% niobium, (b) nitrogen in an amount of about 120 to about 200 ppm and sufficient to provide said vanadium or niobium substantially completely in the form of vanadium nitride or niobium nitride respectively, and (c) substantial absence of added aluminum.

GENERAL DESCRIPTION OF INVENTION

Figure 1:
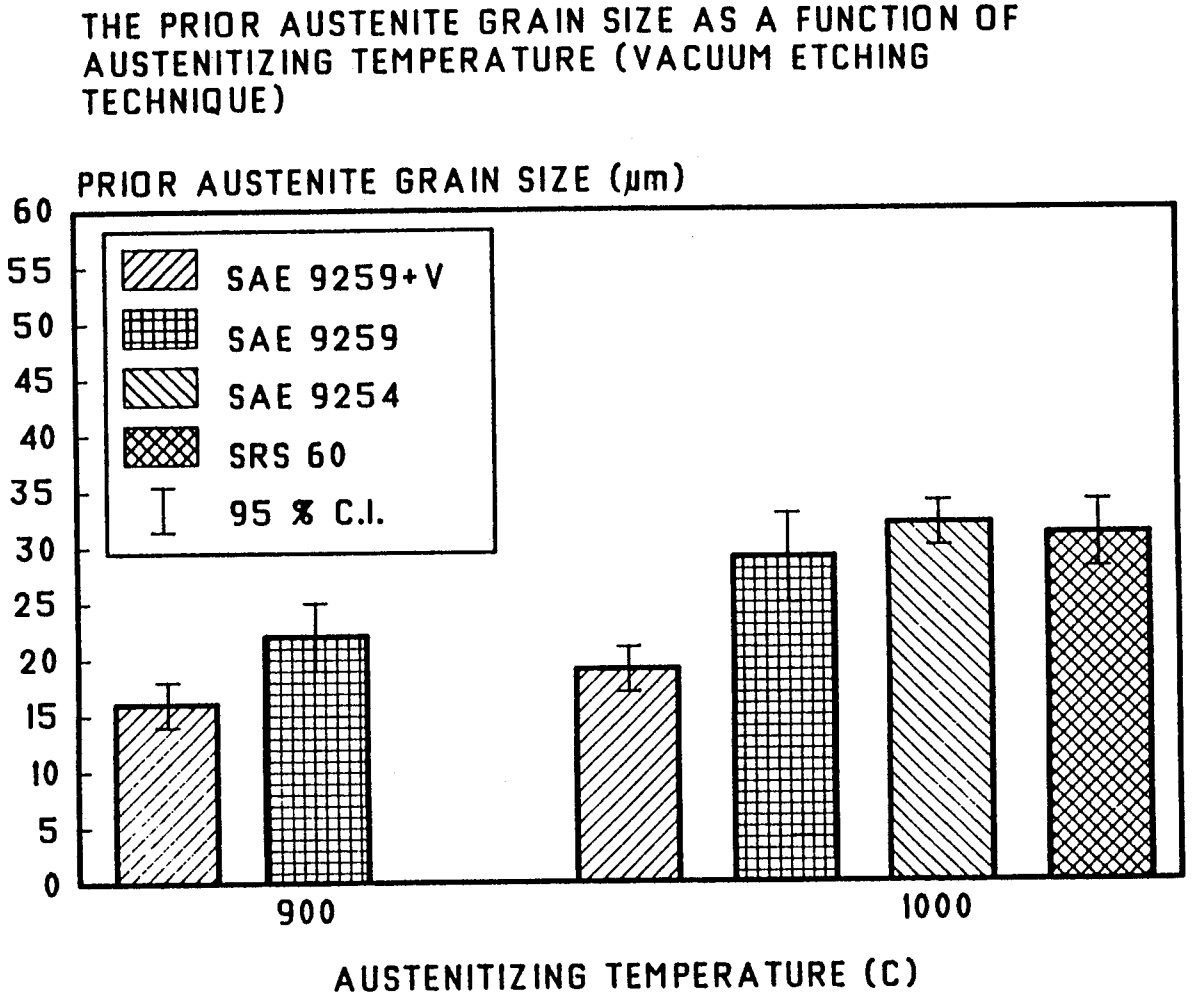
FIGS. 1 to 7 contain graphical representations of test results obtained when comparing a composition formulated in accordance with the present invention (designated SAE 9259+V) with other candidate spring steel compositions in a variety of tests as outlined therein and described in more detail below.

As mentioned above, the trend towards smaller and lighter springs bearing the same load results in higher working stresses in the spring. The higher stresses are compensated for herein by providing a steel composition exhibiting improved fatigue behavior and sag resistance. Fatigue behavior is controlled to a large extent by hardness levels, which in turn are controlled by quench and temper heat treatment. Quenching and tempering to achieve a desired hardness level is relatively independent of steel grade considering the various products currently used in the suspensions. In present practices, springs are processed to hardnesses of about HRC 50. Springs may be processed to higher hardness values of HRC 54 and greater. However, fracture toughness is impeded at these higher hardness levels. Sag resistance also increases with a hardness increase.

In the present invention, a steel composition is employed critically containing vanadium in an amount of about 0.05 to about 0.50 wt%, preferably about 0.080 to 0.130 wt%, or niobium in place of vanadium in an amount of about 0.05 to about 0.20 wt%, nitrogen in an amount of about 120 to about 200 ppm and sufficient to ensure that the vanadium or niobium is present as vanadium nitride or niobium nitride respectively and in the substantial absence of aluminum (less than 0.01 wt%, preferably less than about 0.005 wt%). The presence of the vanadium or niobium in the form of its nitride results in a fine grain size, which not only improves sag resistance but also increases fracture toughness and fatigue life at high hardness values. The low level of aluminum results from employing calcium for deoxidation rather than aluminum and has the effect of lowering the softening point of non-metallic inclusions in the steel, thereby reducing their detrimental effects on fatigue.

Other components which may be present include carbon, silicon and chromium. Sag resistance increases with higher silicon contents and decreases with higher chromium content. Fracture toughness and fatigue behavior are improved by higher silicon or lower carbon contents. Accordingly, a balance of these components is required. In general, the composition of the invention may contain carbon in an amount of about 0.50 to about 0.64 wt%, silicon in an amount from about 0.80 to about 1.35 wt% and chromium in an amount from about 0.05 to about 0.60 wt%. Manganese also may be present in an amount from about 0.60 to about 0.90 wt%.

Other alloying elements which may be present include molybdenum, generally in an amount of about 0.005 to about 0.020 wt%, and niobium, generally in an amount of about 0.001 to about 0.050 wt% (when not otherwise present).

Residual elements often are present in the composition, including nickel, generally in an amount of about 0.005 to about 0.050 wt%; copper, generally in an amount of less than about 0.10 wt%; phosphorus, generally in an amount of less than about 0.020 wt%; sulfur, generally in an amount of less than about 0.025 wt%; lead, generally in an amount of less than about 0.005 wt%; and tin, generally in an amount of less than 0.015 wt%. Accordingly, in a preferred embodiment of the invention, there is provided a steel composition for use in coil and torsion bar suspension springs for passenger cars and light trucks, consisting essentially of (a) about 0.08 to about 0.13 wt% vanadium, (b) nitrogen in amount of about 120 to 200 ppm and sufficient to provide said vanadium substantially completely in the form of vanadium nitride, (c) less than about 0.005 wt% of aluminum, (d) about 0.50 to about 0.64 wt% carbon, (e) about 0.80 to about 1.35 wt% silicon, (f) about 0.05 to about 0.60 wt% chromium, (g) about 0.60 to about 0.90 wt% manganese, (h) about 0.005 to about 0.020 wt% molybdenum, (i) about 0.001 to about 0.005 wt% niobium, (j) about 0.005 to about 0.050 wt% nickel, (k) less than about 0.10 wt% copper, (1) less than about 0.020 wt% phosphorus, (m) less than about 0.025 wt% sulfur, (n) less than about 0.005 wt% lead, (o) less than about 0.015 wt% tin, and (p) the balance by weight of iron.

One specific steel composition (SAE 9259+V) which has been found to be particularly beneficial, as will be seen from the test data set forth in the Example consists of 0.110 wt% of V, 0.0139 wt% N, 0.004 wt% Al, 0.59 wt% C, 0.87 wt% Si, 0.49 wt% Cr, 0.81 wt% Mn, 1.6 wt% Mo, 0.002 wt% Nb, 0.011 wt% Ni, 0.017 wt% Cu, 0.014 wt% P, 0.019 wt% S, 0.003 wt% Pb and the balance by weight of iron.

A further explanation is now provided with respect to the various components of the composition and the quantities of such components which are present. Accordingly, a large improvement in spring sag resistance arises from additions of silicon (up to 2.5 weight per cent). However, high silicon steels, such as SAE 9260 and SAE 9254, tend to have poor surface quality (excessive seams, pits and decarburization) which can be detrimental to fatigue life. By adding small amounts of vanadium or niobium as described above, the total silicon content can be reduced to more moderate levels (less than 1.5 weight per cent) without sacrificing sag resistance. Vanadium and niobium are thought to improve sag resistance by refining the prior austenite grains and by precipitating a fine dispersion of vanadium and niobium carbides or carbonitrides. Sag resistance also is believed to be adversely affected by increased chromium content.

The fatigue properties of spring steels can be improved by considering the role of inclusions and their stress raising effects. By replacing aluminum with calcium during deoxidation, and using vanadium or niobium as a grain refiner, the formation of harmful aluminate-type inclusions is minimized. The total number of inclusions also can be reduced by lowering the sulphur content of the spring steel to very low levels (0.010 to 0.020 weight per cent). Both of these changes in the steel composition maintain the fatigue performance of the spring, especially at higher hardness levels. High chromium levels also are believed known to adversely affect fatigue performance at hardnesses above HRC 50.

The improved results obtained herein are achieved at low costs, similar to conventional grades. The compositions are readily produced using standard procedures. One change in such procedure is to employ calcium for deoxidation rather than aluminum, so as to avoid its adverse effect on the fatigue properties of the steel at high strength levels.

EXAMPLES

EXAMPLE I

This example contains a comparison of components of steel compositions.

A steel composition was formulated in accordance with the present invention and evaluations were made for this steel in comparison to other steel grades which are candidates for suspension springs. The following Table I provides the chemical compositions of the steel compositions:

TABLE I

| Grade/Bar | Alloying Elements (wt %) | | | | | | | | | Residual Elements (wt %) | | | | | |
|---|---|---|---|---|---|---|---|---|---|---|---|---|---|---|---|
| Diameter | C | Mn | Si | Cr | Ni | Mo | V | Nb | $N_2$ | Cu | P | S | Pb | ASA | Total Al |
| SAE 9259 + V (1) | 0.59 | 0.81 | 0.87 | 0.49 | 0.011 | 0.006 | 0.110 | 0.002 | 0.0139 | 0.017 | 0.014 | 0.019 | 0.003 | 0.002 | 0.004 |
| SAE 5160 | 0.59 | 0.81 | 0.28 | 0.82 | 0.007 | 0.002 | 0.008 | 0.002 | 0.0051 | 0.010 | 0.009 | 0.016 | 0.002 | 0.038 | 0.042 |
| SAE 9259 | 0.59 | 0.84 | 0.80 | 0.49 | 0.012 | 0.004 | 0.007 | 0.002 | — | 0.015 | 0.011 | 0.016 | 0.002 | 0.026 | 0.029 |
| SAE 9254 | 0.56 | 0.64 | 1.39 | 0.71 | 0.019 | 0.002 | 0.005 | 0.002 | 0.0053 | 0.008 | 0.012 | 0.006 | 0.002 | 0.030 | 0.034 |
| SRS 60 (2) | 0.57 | 0.44 | 1.50 | 0.55 | 0.010 | 0.002 | 0.170 | 0.002 | 0.0063 | 0.007 | 0.021 | 0.006 | 0.005 | 0.013 | 0.016 |

Notes:
(1) Composition according to the invention.
(2) According to U.S. Pat. No. 4,409,026.

As may be seen from this Table none of the other compositions combines the vanadium and nitrogen contents with the substantial absence of aluminum as in the composition of the invention (SAE 9259+V).

EXAMPLE II

This example contains an evaluation of steel composition cleanliness.

The following Table II contains an evaluation of the cleanliness of the various steels described in Example I (i.e. the quality of inclusion present), effected by quantitative image processing system analysis of the inclusions using optical and scanning electron microscopy and 100X and 500X magnification. As may be seen, the composition of the invention is relatively clean, when compared to the other grades.

TABLE II

| Steel Grade | Predominant Inclusion Type (large inclusions) | Inclusion Measurements (all inclusions) Density (No./mm$^2$) | Aspect Ratio (L/W) | Area ($\mu m^2$) | % Area (Fraction of Total) |
|---|---|---|---|---|---|
| SAE 9259 + V | MnS;CaO/$Al_2O_3$ | 101 | 1.17 | 1.15 | 0.012 |
| SAE 5160 | MnS | 81 | 1.05 | 1.18 | 0.010 |
| SAE 9259 | MnS | 115 | 1.02 | 1.72 | 0.020 |
| SAE 9254 | CaO/$Al_2O_3$ | 70 | 1.11 | 3.36 | 0.029 |
| SRS 60 | MnS | 102 | 0.95 | 2.03 | 0.021 |

EXAMPLE III

This example contains fatigue testing data.

The compositions of Example were subjected to fatigue testing at 1080 MPa stress terminated after 1 million cycles. The results obtained are set forth in Table III below:

TABLE III

| Steel Grade | Maximum Stress (MPa) | Number of Fatigue Failure | Number of Suspended Tests at 1 Million Cycles | $B_{10}$ Estimate |
|---|---|---|---|---|
| SAE 5160 | 1080 | 4 | 4 | 464 000 |
| SAE 9259 | 1080 | 1 | 7 | 714 000 |
| SAE 9259 + V | 1080 | 1 | 7 | 639 000 |
| SAE 9254 | 1080 | 1 | 7 | 669 000 |
| SRS 60 | 1080 | 0 | 8 | N/A |

As may be seen, the 9259+V composition of the present invention suffered one premature failure out of eight tests and this result compares favorably with other grades and, at the same time, shows an improvement over standard grade 5160, which had four premature failures in eight tests.

EXAMPLE IV

This example contains performance data for steel compositions.

Certain evaluations of properties of the various steel compositions were effected and the data obtained was plotted graphically and appears as FIGS. 1 to 7. In this regard, FIG. 1 contains a comparison of the prior austenite grain size as a function of austenitizing temperature for certain steel compositions identified therein, showing that the composition of present invention had a smaller grain size.

Figure 2:
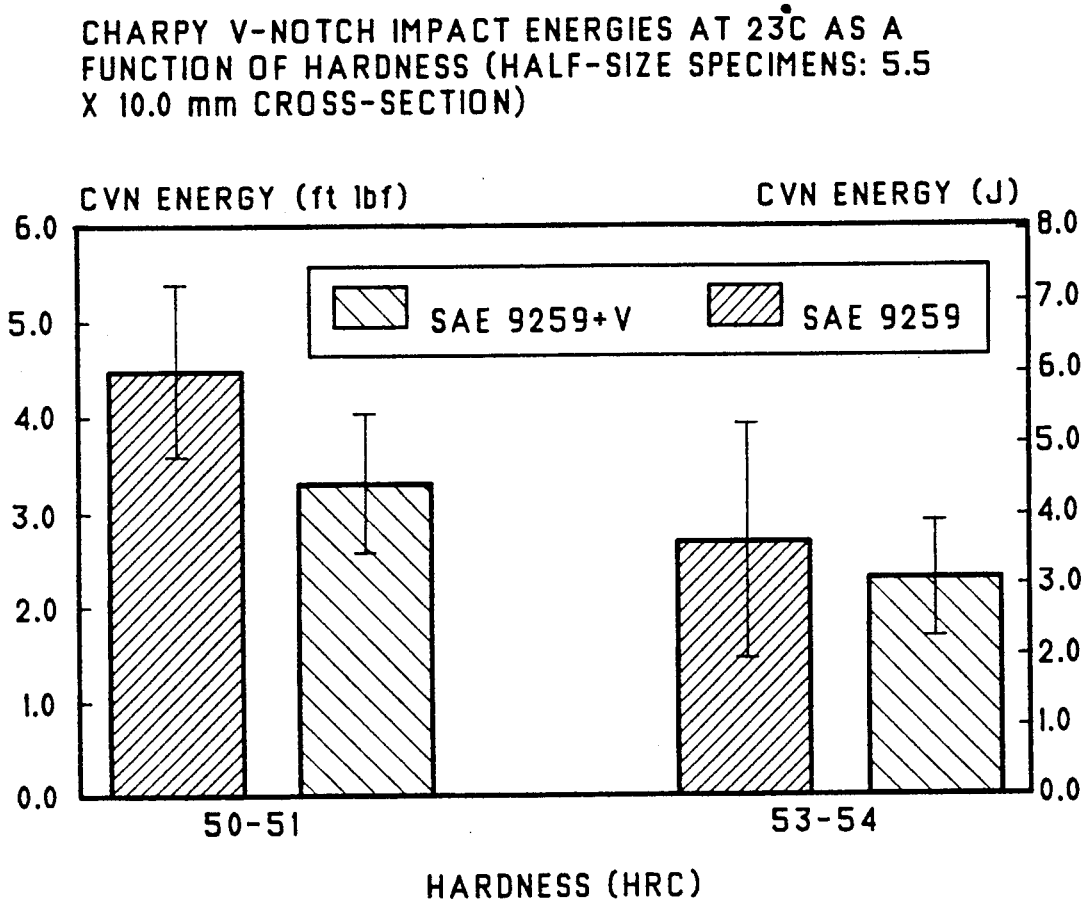

FIG. 2 contains a comparison of the charpy V-notch impact energies for certain steel compositions identified therein, showing greater impact toughness for the composition of the invention.

Figure 3:
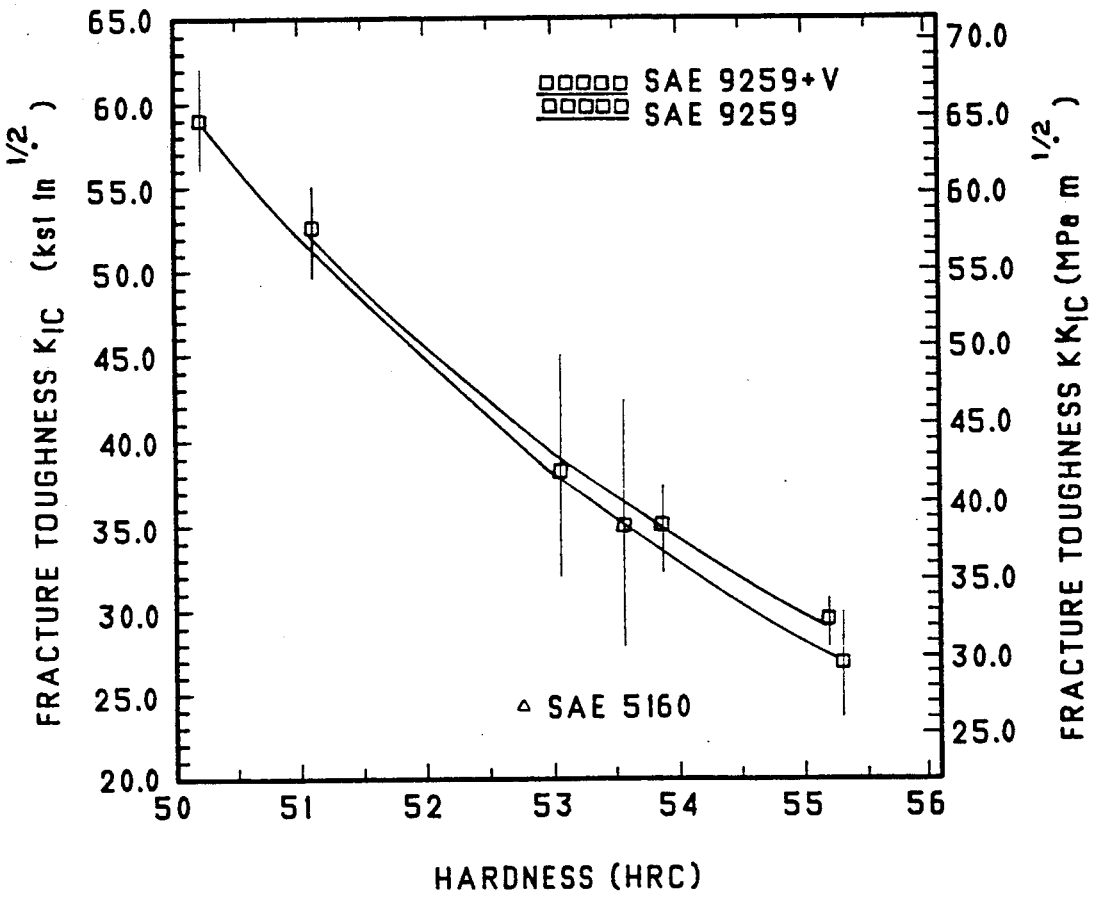

FIG. 3 contains a comparison of the fracture toughness ($K_{IC}$) values for certain steel the compositions identified therein, showing comparable values for the two compositions.

Figure 4:
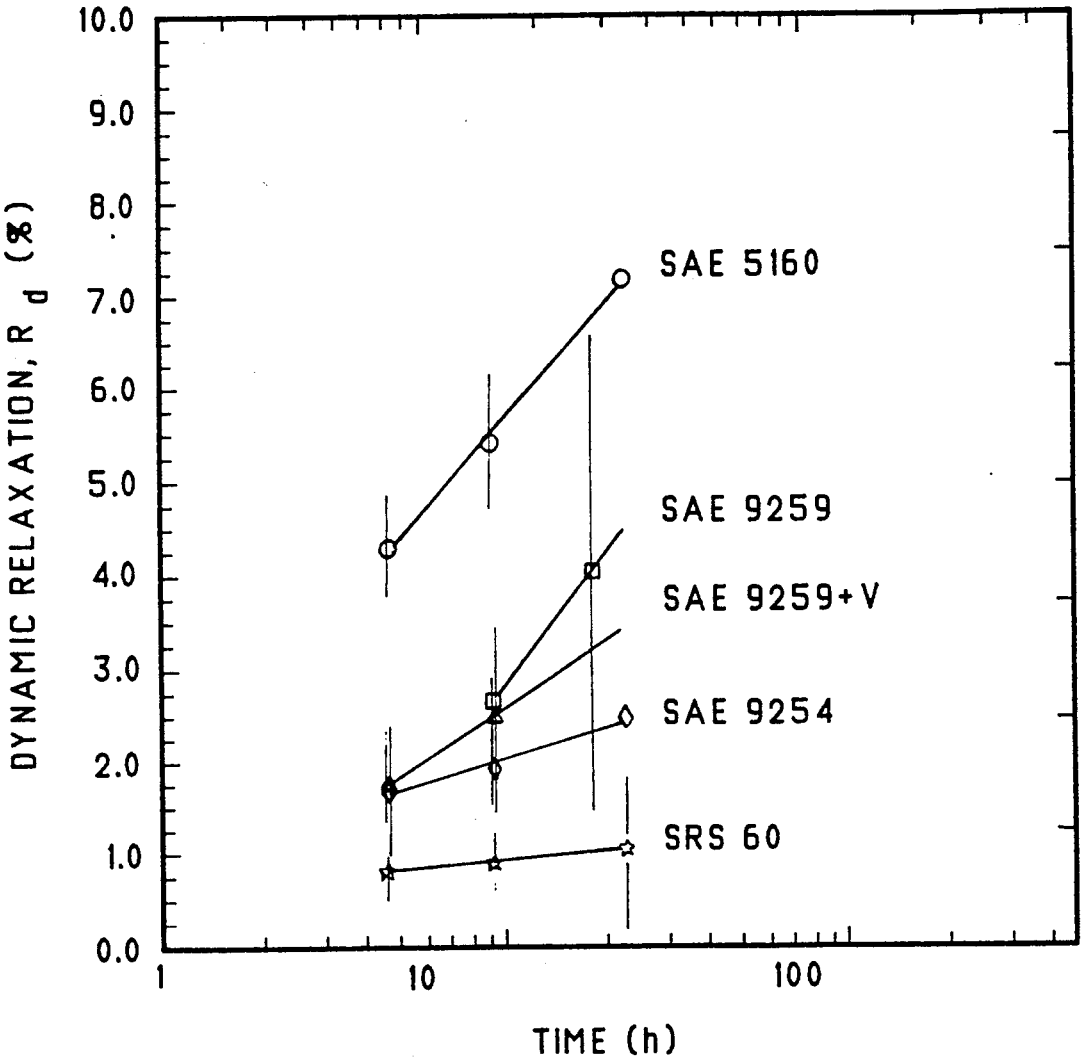
Figure 5:
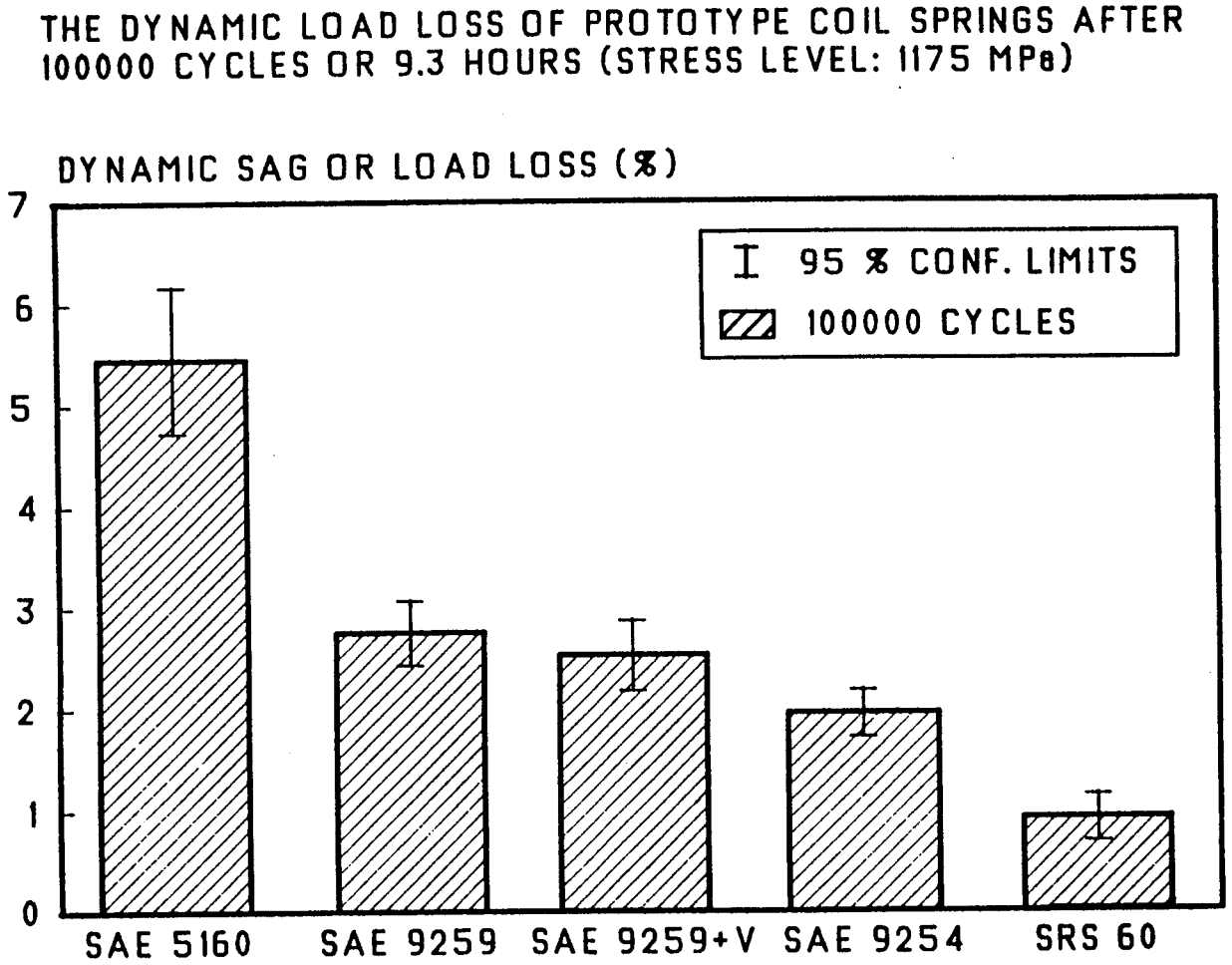
Figure 6:
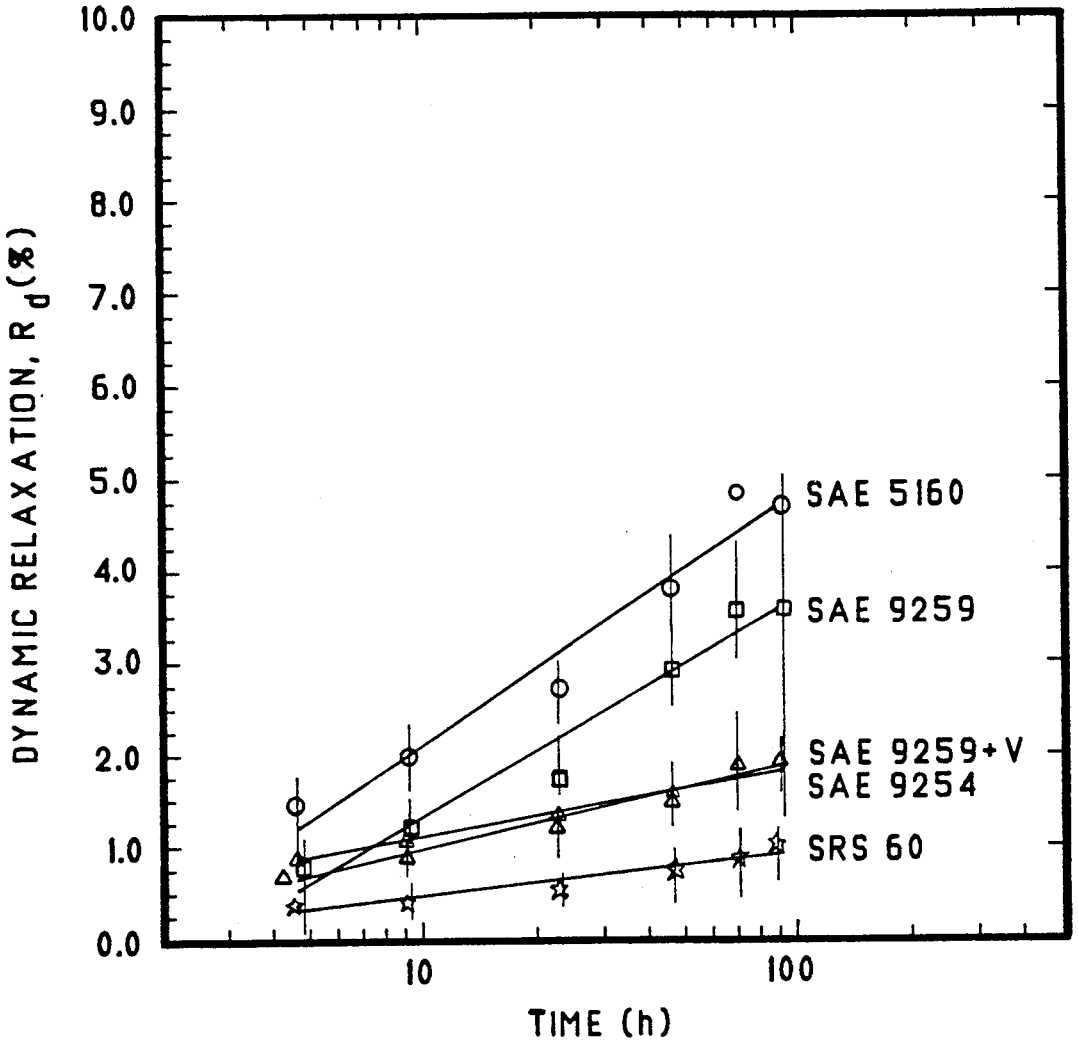
Figure 7:
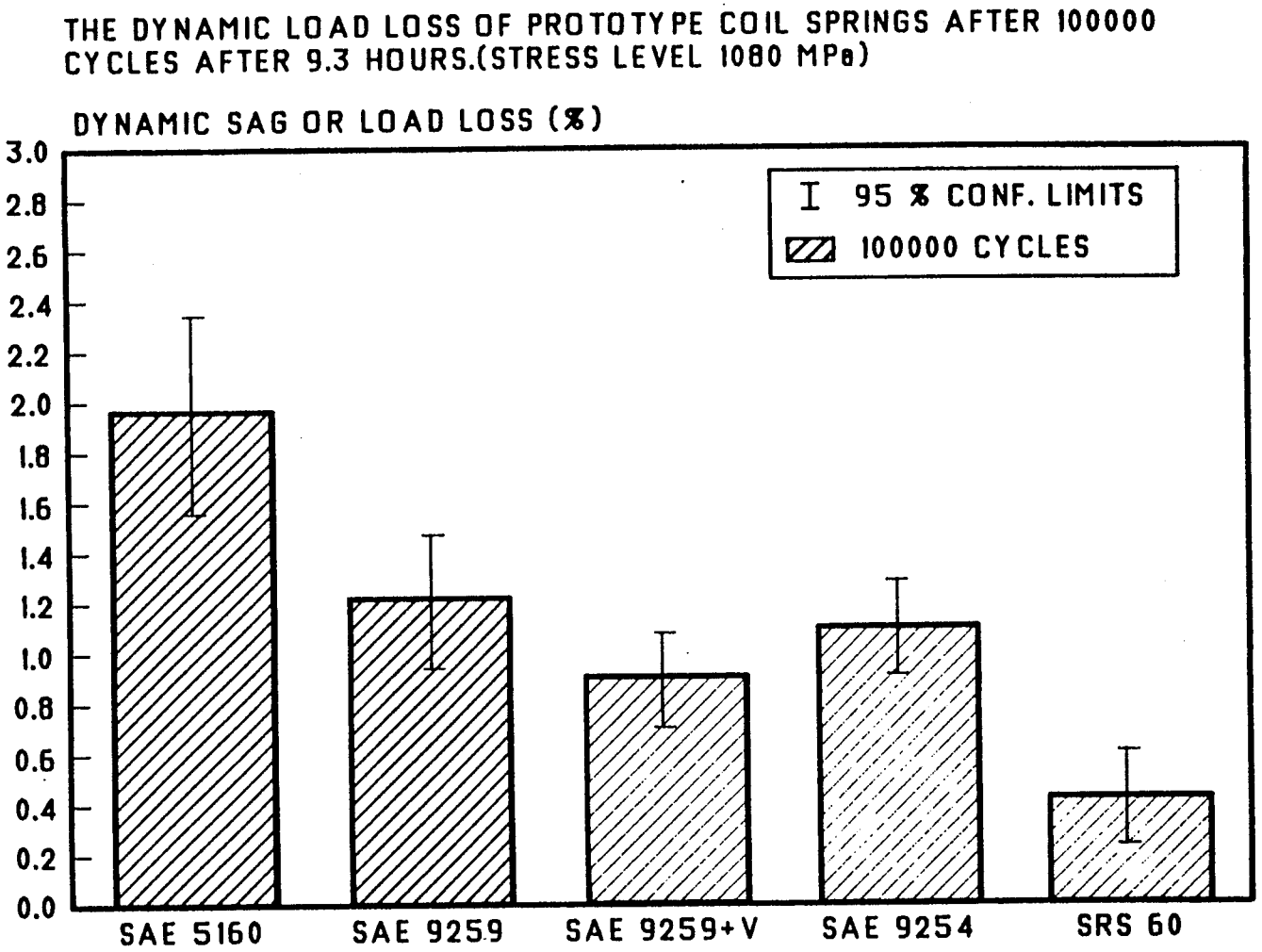

FIGS. 4 to 7 present dynamic sag data in various forms. FIG. 4 contains a comparison of dynamic relaxation properties as a function of time for the steel compositions identified therein, FIG. 5 contains a comparison of dynamic load loss properties for the steel compositions identified therein, FIG. 6 contains a comparison of the dynamic relaxation properties as a function of time for the steel compositions identified therein. FIG. 7 contains a comparison of load loss properties for the steel compositions identified therein. In each case of the tests presented in FIGS. 4 to 7, the compositions of the invention exhibited satisfactory values.

A conclusion that can be drawn from the data is that the very fine grain prior austenite grain size of the SAE 9259+V material, i.e. the steel composition provided in accordance with this invention, yields a significant improvement in sag resistance over conventional SAE 5160 and SAE 9259 and a small improvement in fracture and impact toughness over SAE 9259.

SUMMARY OF DISCLOSURE

In summary of this disclosure, the present invention provides a novel steel composition useful in automobile and light truck coil and torsion bar suspension springs and which has improved mechanical properties. Modifications are possible within the scope of this invention.

What we claim is:

1. A steel composition for use in coil and torsion bar suspension springs for passenger cars and light trucks, consisting essentially of:

(a) about 0.08 to about 0.13 wt% vanadium,
(b) nitrogen in amount of about 120 to about 200 ppm and sufficient to provide said vanadium substantially completely in the form of vanadium nitride,
(c) less than about 0.005 wt% of aluminum,
(d) about 0.50 to about 0.64 wt% carbon,
(e) about 0.80 to about 1.35 wt% silicon,
(f) about 0.05 to about 0.60 wt% chromium,
(g) about 0.60 to about 0.90 wt% manganese,
(h) about 0.005 to about 0.020 wt% molybdenum,
(i) about 0.001 to about 0.005 wt% niobium,
(j) about 0.005 to about 0.050 wt% nickel,
(k) less than about 0.10 wt% copper,
(l) less than about 0.020 wt% phosphorus,
(m) less than about 0.025 wt% sulfur,
(n) less than about 0.005 wt% lead,
(o) less than about 0.015 wt% tin, and
(p) the balance by weight of iron.

2. The composition of claim 1 which consists of 0.110 % of V, 0.0139 wt% N, 0.004 wt% Al, 0.59 wt% C, 0.87 wt% Si, 0.49 wt% Cr, 0.81 wt% Mn, 0.006 wt% Mo, 0.002 wt% Nb, 0.011 wt% Ni, 0.017 wt% Cu, 0.014 wt% P, 0.019 wt% S, 0.003 wt% Pb and the balance by weight of iron.

* * * * *